United States Patent [19]

Suttles

[11] 4,351,244

[45] Sep. 28, 1982

[54] SHELVING SYSTEM

[75] Inventor: James M. Suttles, Elberton, Ga.

[73] Assignee: The Mead Corporation, Atlanta, Ga.

[21] Appl. No.: 116,585

[22] Filed: Jan. 29, 1980

[51] Int. Cl.[3] ..... A47B 3/06

[52] U.S. Cl. ..... 108/107; 52/632; 108/64; 108/110; 108/111; 211/187; 312/263

[58] Field of Search ..... 108/107, 106, 110, 111, 108/114, 64; 211/191, 182, 187, 192; 312/263, 257 SM; 52/108, 716, 717, 288, 632, 282; 248/224.4

[56] References Cited

U.S. PATENT DOCUMENTS

| | | | |
|---|---|---|---|
| D. 247,184 | 2/1978 | Clement | D25/01 |
| 854,654 | 5/1907 | Krantz | 52/282 |
| 860,150 | 7/1907 | Plym | 52/282 |
| 1,129,658 | 2/1915 | Foy | 52/282 X |
| 1,258,043 | 3/1918 | Plym | 52/282 |
| 1,554,011 | 9/1925 | Lehman | 108/107 |
| 2,105,784 | 1/1938 | Hagberg | 52/282 |
| 2,150,795 | 3/1939 | Beckwith | 108/106 X |
| 2,522,097 | 9/1950 | Cookson | 312/263 |
| 2,802,487 | 8/1957 | Breehl | 312/257 SM |
| 2,990,067 | 6/1961 | Bartlett | 248/243 X |
| 3,056,507 | 11/1967 | Squires et al. | 108/107 X |
| 3,281,102 | 10/1966 | Hobson | 248/224.4 |
| 3,306,466 | 2/1967 | Liston | 108/107 |
| 3,357,457 | 12/1967 | Myer | 52/108 X |
| 3,426,115 | 2/1969 | Taber | 264/160 |
| 3,590,759 | 7/1971 | Hendrie, Jr. | 52/716 |
| 3,601,256 | 8/1971 | Bowers, Jr. | 108/108 |
| 3,640,389 | 2/1972 | Snyder | 211/187 |
| 3,669,036 | 6/1972 | Marschak | 108/111 X |
| 3,698,567 | 10/1972 | Fenwick | 211/187 |
| 3,726,413 | 4/1973 | Squires | 108/107 |
| 3,728,834 | 4/1973 | Dean | 52/282 |
| 3,810,340 | 5/1974 | Nelsson | 248/243 X |
| 4,064,996 | 12/1977 | Shillum | 108/107 |
| 4,135,837 | 1/1979 | Suttles | 403/235 |
| 4,148,263 | 4/1979 | Suttles | 108/1 |
| 4,201,139 | 5/1980 | Suttles | 108/109 |
| 4,262,809 | 4/1981 | McConnell | 211/192 |

FOREIGN PATENT DOCUMENTS

| | | | |
|---|---|---|---|
| 920987 | 2/1973 | Canada | 108/111 |
| 642935 | 7/1962 | Italy | 108/111 |
| 864123 | 3/1961 | United Kingdom | 211/187 |

*Primary Examiner*—James T. McCall

*Attorney, Agent, or Firm*—Howson and Howson

[57] ABSTRACT

In a four-post merchandizer, two light-gauge sheet metal corner posts are reinforced against twisting by a dual camming action by which the two posts are urged tightly against the corners of the shelves. Each post comprises two telescoping post sections, and a unitary coilable, flexible trim sheet, received in grooves formed in the post elements, and extending from one end of the post to the other. The posts have a W-shaped horizontal cross-section, in which a pocket is formed for receiving the ends of shelf hooks, thereby protecting the flexible trim from damage. Base panels are secured together by sliding a first flange of one panel into a pocket formed by second and third flanges of another panel and two perpendicular surfaces of a post. By tapering the ends of the first and third flanges, the entry of the first flange into the pocket can be carried out without careful initial alignment. Pairs of post elements are permanently secured in parallel relationship to each other at opposite ends of base panels to provide U-shaped units to facilitate on-site assembly.

16 Claims, 14 Drawing Figures

SHELVING SYSTEM

BRIEF SUMMARY OF THE INVENTION

This invention relates to shelving systems, and particularly to systems of the type used in displaying and merchandising soft drink bottles and other articles, in grocery stores, supermarkets and the like.

Many of the soft drink merchandisers currently available are of the four-post type, i.e. they comprise a rectangular base having four sheet metal posts extending upwardly from the four corners of the base, and a series of shelves supported on the posts, one above another, in the desired positions. In general, it is desirable to provide the posts with slots, hooks, or other means permitting the adjustment of the vertical positions of the shelves. Most practical fourpost shelving units heretofore available utilize slotted posts and specially designed clips to attach the shelves to the posts.

One problem which has arisen in the design of four-post shelving units has been the problem of achieving stability while utilizing as little material as possible in order to minimize shipping costs. In general, light-gauge sheet metal posts can be so formed as to resist bending under load. However, it is difficult to make a light-gauge sheet metal post which will resist torsion or twisting. When the posts of a shelving unit are able to twist, the shelving unit as whole is unsatisfactory because it will tend to deform when heavily loaded and will sway when bumped by a customer. Accordingly, the general practice in the art of sheet metal shelving has been to use comparatively heavy-gauge posts or to use elaborate post reinforcements.

One of the important objects of this invention is to provide a shelving system of the four-post type which is comparatively light in weight and yet stable enough to provide satisfactory service as a free-standing unit. The foregoing object is achieved in accordance with the invention, in a fastener-free shelving unit, by utilizing a novel hook and slot arrangement in which the slot has a camming surface which cams the hook in one direction, and the hook has a camming surface which cooperates with an edge of the slot to cam the hook in a different direction. When the hook on a shelf is engaged in a slot in the post, this dual camming action causes mutually engageable means on the post and shelf to be brought tightly together. These mutually engageable means secure the post and shelf to each other in such a way that the shelf reinforces the post against twisting. As a result, posts of the shelving system made in accordance with the invention can be of relatively light-gauge metal.

Unitary posts formed of light-gauge sheet metal, while susceptible to twisting, are not particularly susceptible to bending. However, as will appear, posts in accordance with the invention are preferably made up of interconnected post elements. Unlike unitary posts, posts made up of interconnected elements are frequently susceptible not only to twisting, but also to bending. The dual camming feature, whereby the shelves serve as reinforcements for the post, is of particular importance where the posts are made up of two or more interconnected elements, as the dual camming feature reinforces the posts against bending as well as against twisting.

Most four-post merchandisers are about seven feet high. For cosmetic resons, as well as for reasons of strength, most merchandisers utilize unitary posts which are a full seven feet long. The length of the posts is much greater than the largest dimension of any other part of the merchandiser. Consequently, the posts present a serious problem in packaging and shipping the merchandisers in kit form. While the posts could be made up of two or more parts, such a construction gives rise not only to problems of strength, but also gives rise to cosmetic problems. That is, a post made up of two or more pieces inherently has a discontinuity at the juncture of the parts of the post.

A further object of the invention is to provide a shelving system having a multiple-part post which does not have the cosmetic deficiencies inherent in two-part post assemblies.

In order to achieve the foregoing objective, the post in accordance with the invention comprises upper and lower sheet metal elements which, when connected, provide two elongated grooves extending substantially the full length of the assembled post. These grooves receive the opposite edges of an elongated coilable flexible sheet of self-coiling polyester or similar material, which may be provided in any desired color, or printed with patterns, or product logos.

When the posts of the shelving unit are assembled to their full seven foot length, the upper ends of the posts may be quite near the ceiling in some locations. However, since the trim is coiled in its normal condition, it can be fed from the coil downwardly into the grooves of the posts, where it can remain indefinitely. While discontinuities are visible in the junction between the upper and lower post elements, there are no discontinuities in the flexible, coilable sheet. Therefore, if the flexible, coilable sheet is provided in a color or pattern which is likely to attract attention, the effect is to obscure the discontinuities in the post assembly.

Another object of the invention is to provide a shelving system having posts of a standard construction, in which the trim of the posts can be easily varied. This object is achieved by providing posts having grooves formed by return flanges, and by providing trim in the form of an elongated, coilable flexible sheet held in the grooves of the posts. Where the post is a corner post, a W-shaped construction of the web of the post provides a pocket for receiving shelf hooks. This pocket prevents the shelf hooks from interfering with the flexible trim of the posts, and from projecting to a location where they might cause injury to customers. The pocket of the W-shaped post also has the inherent advantage of providing clearance for a back panel of a shelving unit.

Fastener-free bases in which base panels are secured together by relative sliding movement of parts are well-known in the art (see for example U.S. Pat. No. 3,601,256, dated Aug. 24, 1971). It is frequently difficult to assemble these bases because of the need for positioning parts of the respective base panels carefully before they are secured together. Viewing the parts is especially difficult when a shelf-supporting post is already secured to one of the base panels. It is therefore an object of the invention to provide a base assembly for a sheet metal shelving system in which the base panels can be readily secured together, and which results in a high-strength base assembly. In accordance with the invention, one of the base panels is provided with a first perpendicular flange. The other panel which meets the first panel at a corner of the base, is provided with a second perpendicular flange, and a third flange forming an acute angle with the second perpendicular flange.

Means secured to the second panel, cooperate with the second and third flanges to form a pocket for receiving the first flange. The first flange is tapered at its lower edge, the third flange is tapered at its upper edge, these tapers providing guidance for the respective flanges as the first flange is moved downwardly into the pocket. As a result, the base panels can be readily secured together by sliding the flange of one into the pocket formed in the other without the need for accurate initial placement of parts.

Other objects and advantages of the invention will be apparent from the following detailed description when read in conjunction with the drawings.

DETAILED DESCRIPTION

Figure 1:
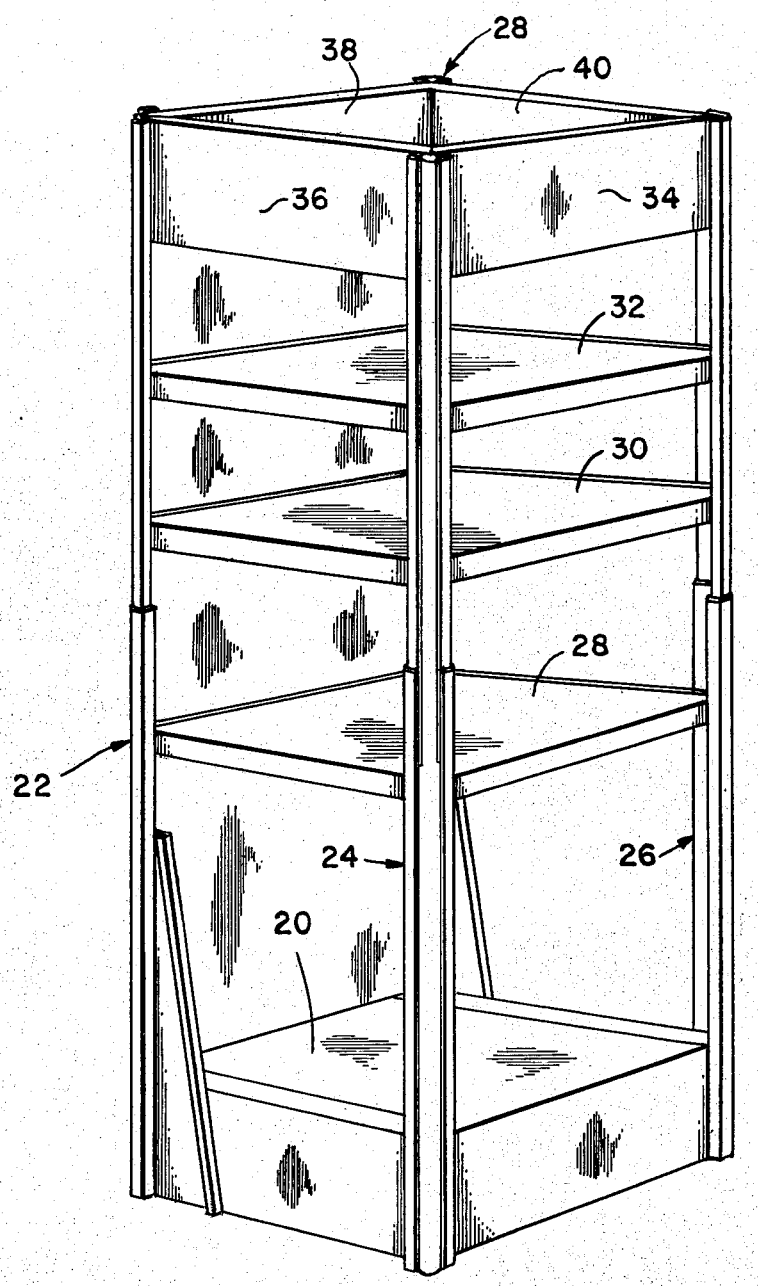
FIG. 1 is a perspective view of a preferred fourpost shelving unit in accordance with the invention.

As shown in FIG. 1, the shelving unit comprises a base 20 providing a raised article-supporting surface, and four posts 22, 24, 26 and 28 secured to and extending upwardly from the respective four corners of the base. Shelves 28, 30 and 32 are supported one above another on the posts, the corners of the shelves being connected to the posts in the manner which will be described with reference to FIGS. 9–12. At the upper ends of the posts, a conventional canopy assembly is provided by panels 34, 36, 38 and 40. These panels can serve as signs if desired, and they may be provided at their lower edges with inwardly projecting flanges for supporting a translucent light diffuser.

Figure 2:
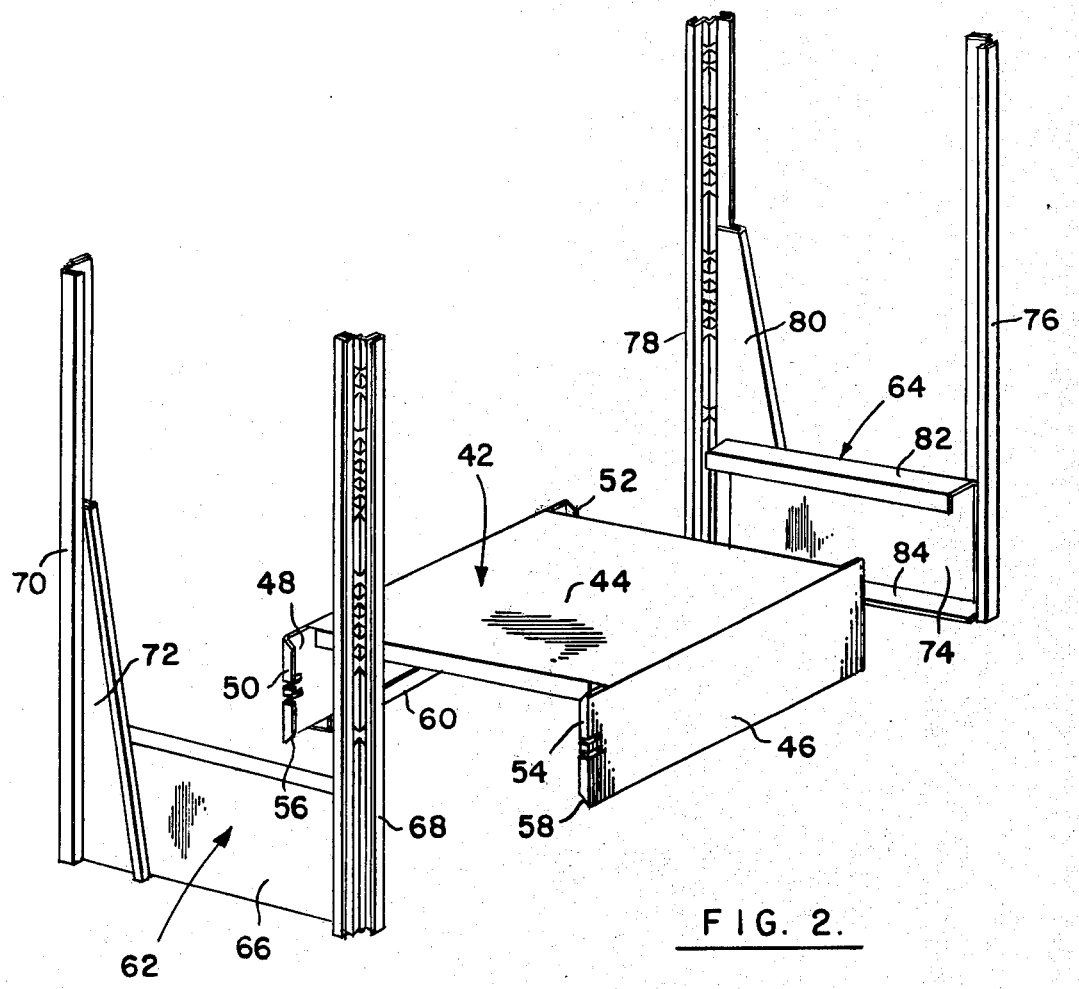
FIG. 2 is an exploded view of the base assembly of the unit.

As shown in FIG. 2, the base assembly, as supplied, consists of three unitary members. Member 42 is a sheet metal member formed to provide a supporting surface 44, a front panel 46 and a rear panel 48. Rear panel 48 has at its side edges, forwardly projecting flanges 50 and 52. Front panel 46 has similar rearwardly projecting flanges, one of which is seen at 54. It should be noted that the lower edges of these flanges are tapered, as indicated at 56 and 58. Inwardly projecting flanges are also provided at the lower edges of panels 46 and 48, the flange on panel 48 being indicated at 60. The purpose of these latter flanges is merely to provide a large floor contact area.

FIG. 2 also shows two generally U-shaped assemblies 62 and 64. Assembly 62 comprises a generally rectangular sheet metal panel 66 having upright sheet metal post elements 68 and 70 permanently secured to its opposite ends by spot welding. A generally triangular reinforcing bracket 72 is connected between posts 70 and panel 62. Assembly 64 similarly comprises post elements 76 and 78, which are welded to panel 74, and a reinforcing bracket 80. The upper and lower edges of panels 66 and 74 have inwardly projecting flanges, the flanges at panel 74 being indicated respectively at 82 and 84.

Figure 3:
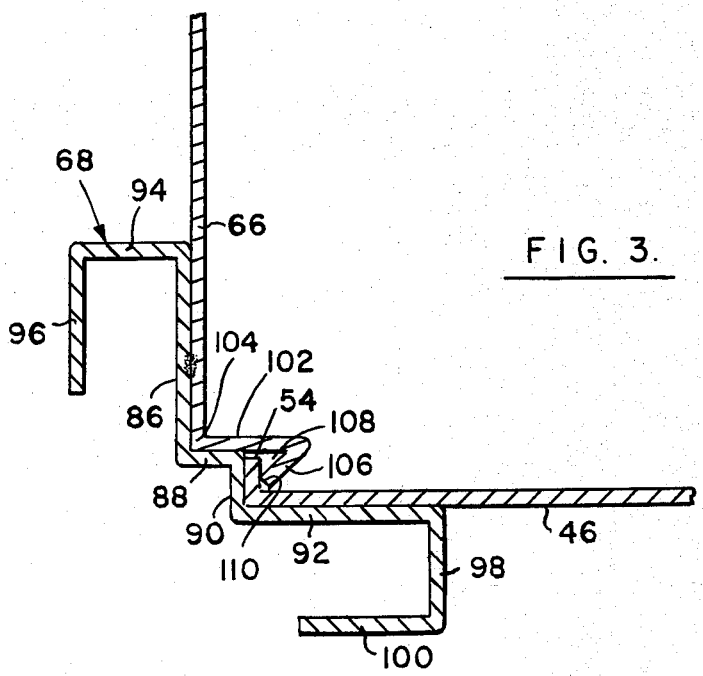
FIG. 3 is a fragmentary horizontal section taken through a corner of the base assembly and illustrating the means by which the base panels are secured together.

FIG. 3 shows the manner in which the elements of FIG. 2 are secured together. The interconnections at all four corners are substantially the same. Post element 68 has a W-shaped web comprising vertically elongated rectangular sections 86, 88, 90 and 92. Sections 86 and 92 are perpendicular to each other, and sections 88 and 90 are respectively perpendicular to sections 86 and 92. The post section includes section 94 projecting outwardly from web section 86, and a return flange 96 which is parallel to and spaced from web section 86. A similar outwardly projecting section 98 is connected to web section 92, and a return flange 100, parallel to web section 92 is provided. Panel 66 is permanently secured to web section 86 by spot welding, as shown.

A flange 102 projects inwardly from vertical edge 104 of panel 66 in parallel relationship to panel 46. An additional flange 106 extends from and forms an acute angle with flange 102.

Web sections 90 and 92 of the posts, together with flanges 102 and 106 of panel 66, form a pocket 108 for receiving flange 54 of front panel 46. When the panels are interconnected as shown in FIG. 3, edge 110 of flange 106 extends into and contacts the corner formed by panel 46 and its flange 54, and holds flange 54 against web section 90 while also holding the face of panel 46 against web section 92.

Preferably, the flanges of panel 66 are so related to the sections of post element 68 that the normal distance between end 110 of flange 106 and web section 90 is slightly less than the thickness of flange 54. Similarly, the normal distance between end 110 of flange 106 and web section 92 is preferably slightly less than the thickness of panel 46. Thus, in order to insert flange 54 into pocket 108, flange 102 must be sprung slightly so that end 110 of flange 106 is moved away from the corner formed by web sections 90 and 92. The spring characteristic of flange 102 causes flange 106 to bear against the corner formed by panel 46 and flange 54 to secure the panels firmly together.

Figure 4:
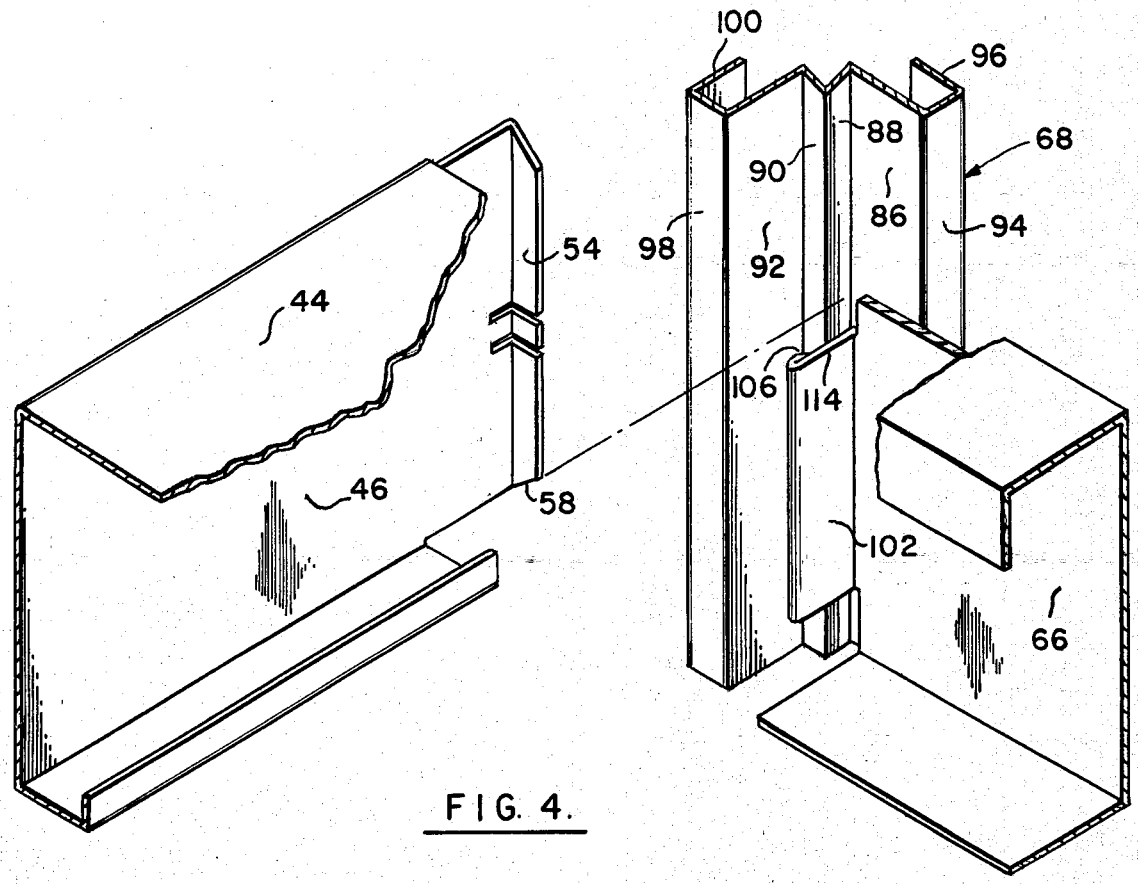
FIG. 4 is an exploded view showing details of the base panel assembly.

Referring to FIG. 4, the panels are secured together at the corner by sliding flange 54 downwardly into the pocket formed by elements 90, 92, 102 and 106. When the front and rear panels are permanently connected to each other, as is the case in the base of FIG. 2, the engagement of all four corners is preferably carried out simultaneously. Even if the front and rear panels were separate and installed independently of each other, both vertical edges of each panel would be engaged simultaneously with both side panels.

Figure 5:
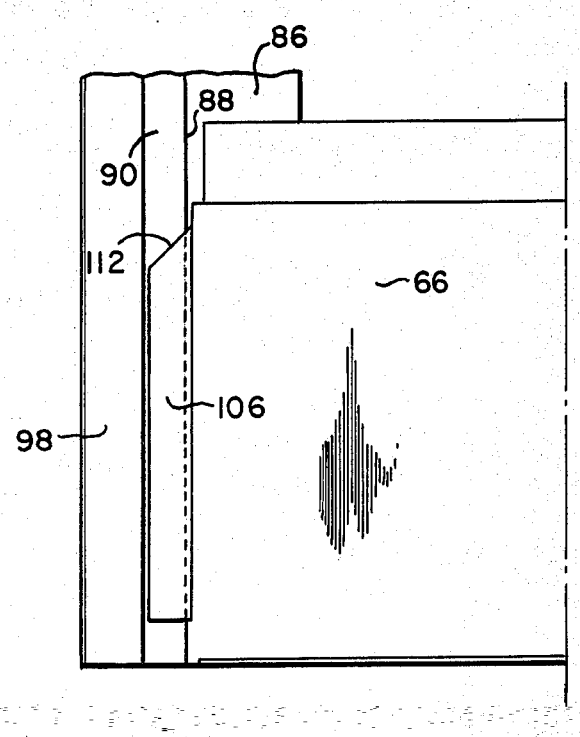
FIG. 5 is a fragmentary elevational view of a side panel of the base, as viewed from the inside of the base assembly.

Because of the close relationship between edge 110 of flange 106 (FIG. 3) and the corner formed by web elements 90 and 92, it would be difficult to insert flange 54 into the pocket if no special precautions were taken. Insertion is also made difficult by the presence of the posts which are permanently secured to the side panels, as the posts prevent personnel from positioning their eyes in such a way as to align the flanges of the front and rear panels with the pockets formed on the side panels. The difficulty of alignment is compounded by the necessity for assembling multiple corners of the base system simultaneously. In order to overcome these problems, the upper edge 112 of flange 106 (FIG. 5) is tapered in such a way as to guide flange 54 of the front panel into place by a camming action. The tapering of edge 112 serves to urge flange 54 toward web section 90. As shown in FIG. 4, lower edge 58 of flange 54 is also tapered. Lower edge 58 cooperates with upper edge 114 of flange 102 to produce a further camming action urging panel 46 toward web section 92. As a result, the means for securing the panels together at the corner of the base, as shown in FIG. 3, can be used effectively, since the camming actions just described make it possible to assemble the elements easily.

Figure 6:
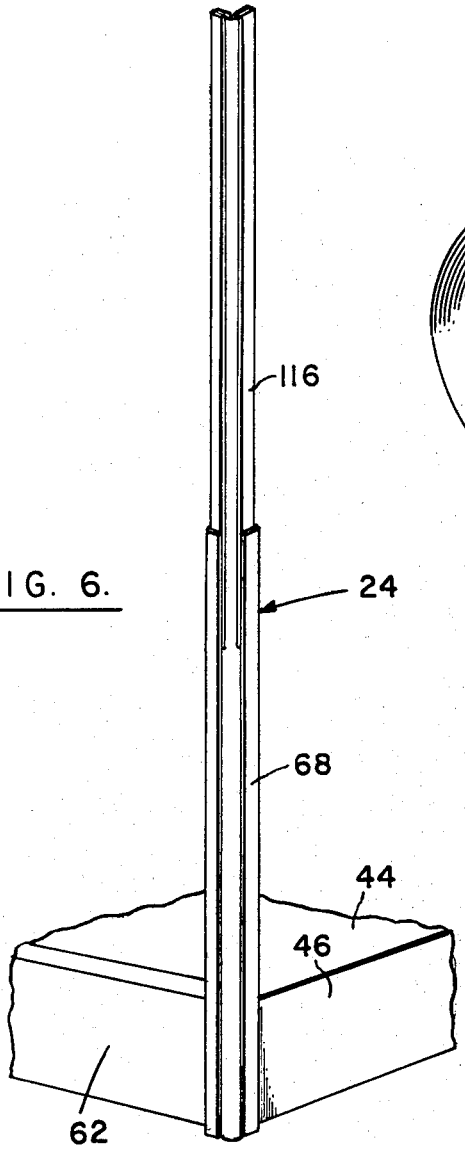
FIG. 6 is a perspective view of a two-section post, with a flexible, coilable trim sheet installed.

U-shaped assemblies 62 and 64, shown in FIG. 2, contribute to the strength of the shelving unit by reason of the fact that the posts are permanently secured to the side panels by welding. They also contribute to the simplicity of assembly, by reducing the number of separate parts. At the same time, as these preassembled U-shaped structures are not significantly larger than the other elements of the assembly, such as the shelves and the base, they do not materially increase the necessary size of the package in which the unit is shipped in a taken-down condition. Supplying the U-shaped elements in preassembled form in this manner, however, requires the use of two-section posts. As shown in FIG. 6, post 24 comprises a lower post element 68, and an upper post element 116, which has the same general configuration as post element 68, but which is of a smaller size so that it can telescope into the upper end of post element 68. The lower end of post element 116 rests on struck-out tabs (not shown) formed in element 68.

Figure 7:
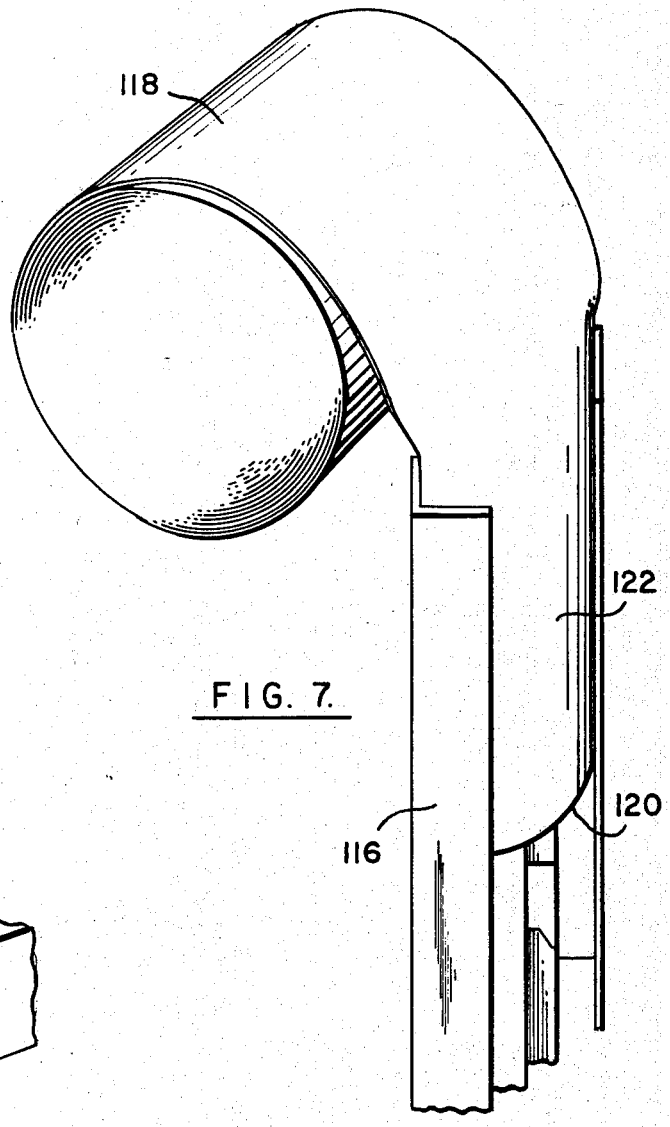
FIG. 7 is a perspective view illustrating the manner in which the flexible, coilable trim sheet is installed in a post.

When the post is fully assembled, trim is installed in the manner illustrated in FIG. 7. Preferably, the trim consists of a coilable flexible polyester sheet, treated in such a way that it has a memory, causing it to retain its coiled form, unless it is held in an uncoiled condition. A method of treatment is described in Taber U.S. Pat. No. 3,426,115, dated Feb. 4, 1969, the disclosure of which patent is here incorporated by reference.

Figure 9:
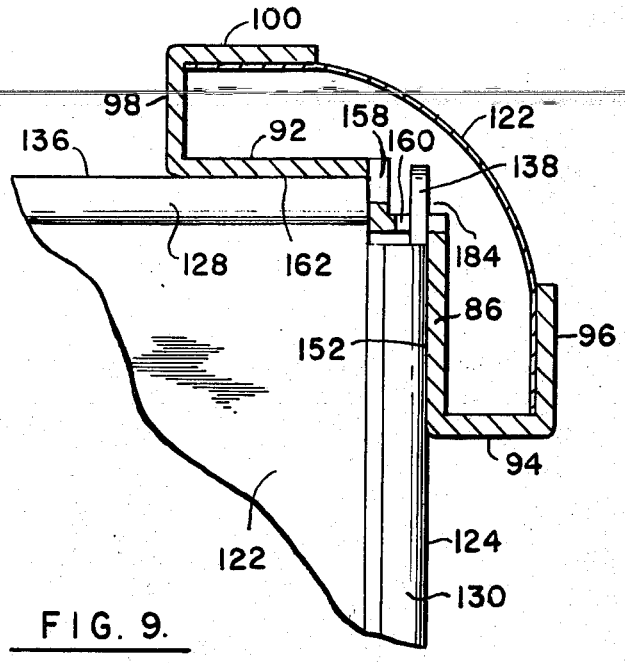
FIG. 9 is a horizontal section through a front corner of the shelving unit, illustrating the means by which the post and a shelf are tightly secured together and also illustrating the means by which the trim sheet is held in place.

At the free end of coil 118, the side edges are manually brought toward each other to cause the end 120 to become curved so that it is able to enter the upper end of post element 116. The lower end 120 is fed downwardly into the post, as coil 118 is unrolled, until the sheet extends substantially the fully length of the post. The return flanges of the respective post elements 116 and 68 form continuous grooves receiving the edges of the sheet 122. As shown in FIG. 9, the distance between post sections 94 and 98 in such that when sheet 122 is held between the grooves formed by return flanges 96 and 100, the exposed face of the sheet is convex. The memory of the sheet also causes it to tend to return to a straight condition in horizontal cross-section. As a result, the edges of the sheet bear outwardly against return flanges 96 and 100.

The flexible coilable sheet can be printed with patterns, product logos or the like in any desired color or combination of colors. Although the posts are discontinuous because of the fact that each consists of two interconnected post elements, the trim sheet in each post is continuous, and tends to obscure the discontinuity of the posts.

The post sections are preferably assembled when the lower post sections are in an upright condition, particularly because pairs of lower post elements are permanently secured together. Consequently, the upper ends of the upper post elements may be very near the ceiling of a room or other enclosure in which the assembly takes place. However, since the sheet is coiled, it can be installed while the posts are upright, without requiring an additional clearance above the upper ends of the posts, equal to the height of a post.

Figure 8:
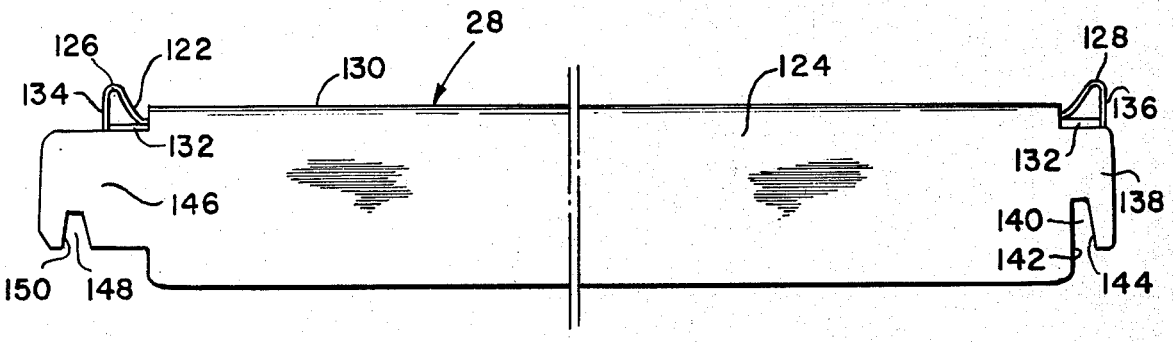
FIG. 8 is a side elevation of a shelf showing the front and rear shelf hooks.

FIG. 8 shows the configuration of the front and rear hooks of shelf 28. The shelf is preferably formed from a light-gauge sheet metal element 122 which provides the main article-supporting surface, and heavy-gauge sheet metal side members, one of which is indicated at 124. One or more reinforcing channels (not shown) may be provided underneath element 122, if desired. Retaining ridges are formed in member 122 at 126 and 128, and similar retaining ridges are formed on the side members, the retaining ridge on side member 124 being indicated at 130. Side member 124 has a horizontal flange 132, which extends substantially the full length of side member 124, and is located directly underneath sheet metal element 122. Element 122 is secured to flange 132 by spot welding. The counterpart of side member 124 (not shown) on the opposite side of the shelf is similarly secured to the opposite edge of member 122.

Side member 124 and its counterpart at the opposite side of the shelf serve as skirt flanges for reinforcing the shelf. Front and rear skirt flanges are provided by extensions of element 122 at 134 and 136. These extensions project downwardly from retaining ridges 126 and 128 respectively.

Adjacent the front edge of the shelf, side element 124 is formed into a hook 138, with a downwardly open notch 140. While the rear edge 142 of the notch is vertical, the front edge 144 of notch 140 is oblique, so that the upper end of edge 144 is closer to the rear of the shelf than is the lower edge. At the rear of element 124, a similar hook 146 is formed. Unlike hook 138, the front edge of which is adjacent front skirt flange 136, the rear edge of hook 146 projects beyond rear skirt flange 134. A notch is provided at 148, and the rear edge 150 of the notch is oblique so that its lower end is more rearward than its upper end. The front edge of the notch is also oblique so that the notch has a relatively wide opening.

Figure 13:
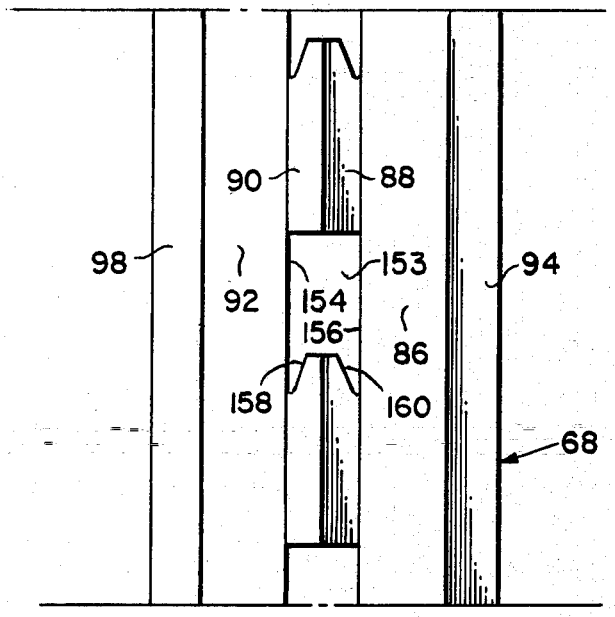
FIG. 13 is a three quarter view showing the inside of a post in accordance with the invention.

As shown in FIG. 13, the V-shaped section of the web of lower post element 68 is provided with a series of slots corresponding to slot 153. The upper post element is provided with similar slots. The outer edges 154 and 156 of slot 153 are aligned with the faces of web sections 92 and 86 respectively.

Oblique camming surfaces 158 and 160 are provided in web sections 90 and 88 respectively. From FIG. 13 it is apparent that the post element is symmetrical about a vertical plane extending through the juncture of web sections 90 and 88, and bisecting the angle formed by the faces of web sections 92 and 86. This symmetry is desirable so that the same post element can be used at any corner of the shelving unit. In the case of post element 68, camming surface 160 receives the shelf hook, while camming surface 158 is unused. However, in the lower element of post 26 (FIG. 1), the camming surface corresponding to surface 158 is used, while the camming surface corresponding to surface 160 is unused. This symmetry is beneficial from a manufacturing standpoint. In addition, when applied to the upper post elements, symmetry simplifies on-site assembly, since it allows all four upper post elements to be identical.

In FIG. 9, hook 138 extends through the slot having camming surface 160, and camming surface 160 cooperates with hook 138 in such a way that the hook is urged toward the right so that skirt flange 124 is pressed tightly against face 152 of web element 86.

Figure 12:
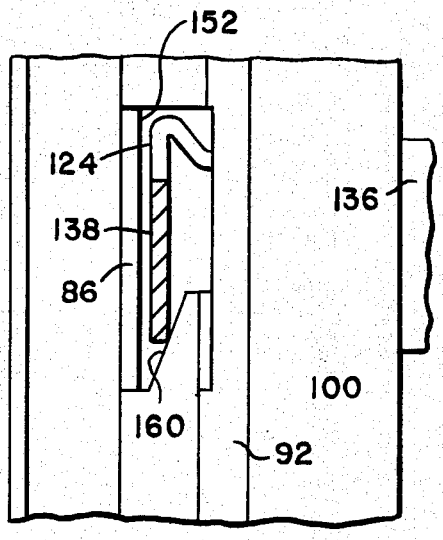
FIG. 12 is a front elevation of a corner post in which the hook is shown in section, and in which the flexible trim sheet is removed, and illustrating the camming action of a slot in the post.

The manner in which this camming action is achieved is illustrated in FIG. 12, which shows hook 138 in a partially engaged condition with the slot. Preferably, the post and skirt flange 124 are sufficiently resilient to allow the shelf to move downward with respect to the post beyond the position of the shelf at which skirt flange 124 first engages face 152 of web section 86. The resiliency needed in order to accomplish this can be resiliency in the skirt flanges of the shelf, or in the post, or both. Resiliency of the hook can also be used to accomplish this objective. The resiliency, and the relationship just described is desirable in order to insure that the posts are held tightly against the shelves, even when the shelves are unloaded.

Figure 11:
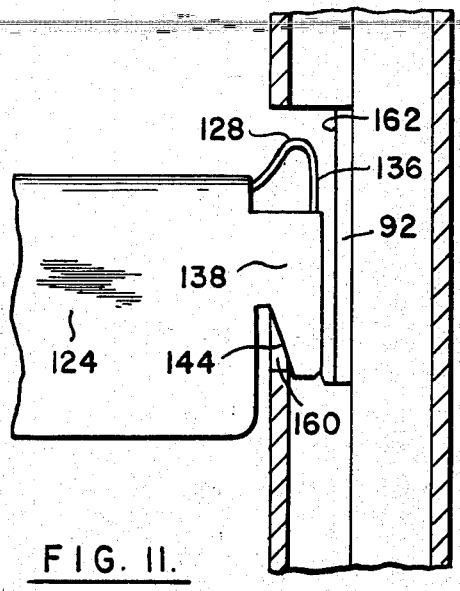
FIG. 11 is a vertical section taken through a front corner post on a plane parallel to the side of a shelf, and illustrating the camming action of the shelf hook.

Returning to FIG. 9, the front skirt flange 136 of the shelf is held tightly against face 162 of web element 92. This tight relationship is accomplished by the engagement of oblique edge 144 of hook 138 with camming surface 160, as shown in FIG. 11, which shows the hook and slot in a partially engaged position. Here again, the resiliency of the posts and of front skirt flange 136 of the shelf allow the shelf to move downwardly slightly beyond the position of the shelf at which flange 136 first comes into engagement with face 162.

In FIG. 9, the front flange 136 of the shelf is held tightly against face 162 of post web element 92, and side flange 152 is similarly held tightly against post web element 86 which is non-parallel to post element 92. The tight engagement of these elements is accomplished by the dual-camming action of the hook and slot. Because of this tight engagement of the shelf with the post in two non-parallel planes, the post is unable to rotate about a vertical axis with respect to the shelf. So long as the other corners of the shelf are reasonably well supported against lateral movement by the other posts, the shelf serves as a lever arm locking the post of FIG. 9 against twisting.

It should be noted that only the front posts 24 and 26 (FIG. 1) are restrained against twisting by tight engagement with the shelf. Each shelf locks each of the two front posts against twisting in the same way. The result is a highly stable shelving unit which is resistant to deformation under heavy loads and which does not sway when bumped, for example, by a shopping cart.

Figure 10:
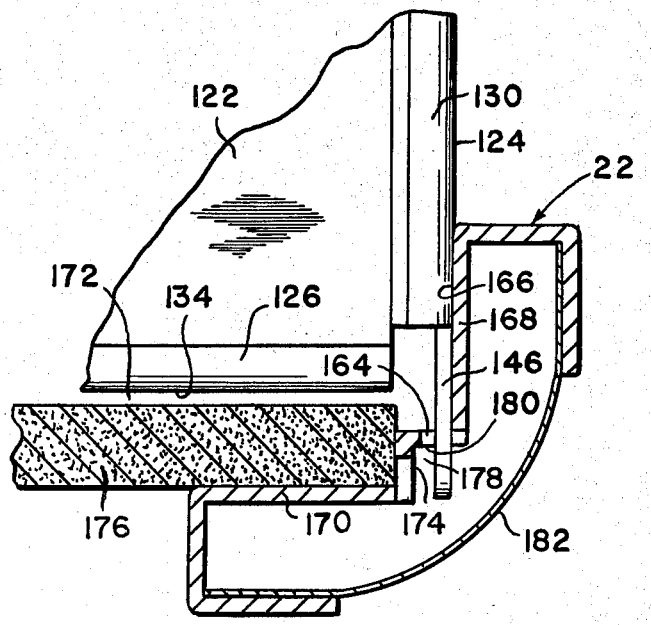
FIG. 10 is a horizontal section through a rear corner of the shelving unit, illustrating the manner in which the rear corner of the shelf is secured to a post, and also illustrating the means by which clearance is provided for a panel at the rear of the shelf.

The connection between the shelf and rear post 22 is illustrated in FIG. 10. The camming action of oblique camming surface 164 urges skirt 124 of the shelf tightly against face 166 of web element 168. However, there is a clearance between the rear skirt 134 of the shelf and the face of web element 170. Consequently, post 22, and the other rear post 28 are not restrained against twisting by tight engagement with the shelves. It is for this reason that triangular braces 72 and 80 (FIG. 2) are desirable.

A clearance is provided at 172 between rear skirt flange 134 of the shelf and web element 170, and this clearance arises partly by reason of web element 174. A rear panel 176 of the shelving unit is received in the space between web element 170 and the shelf, while still further clearance is provided to allow easy entry of the front hooks of the shelf into the slots of the front posts. A pocket 178 formed by sections 174 and 180 of the posts receives the end of hook 146, thereby preventing interference between the hook and trim sheet 182. This pocket also prevents the hook from projecting outwardly to a location where it could injure customers or cause damage to their clothing. The front post shown in FIG. 9 has a similar pocket indicated at 184.

Figure 14:
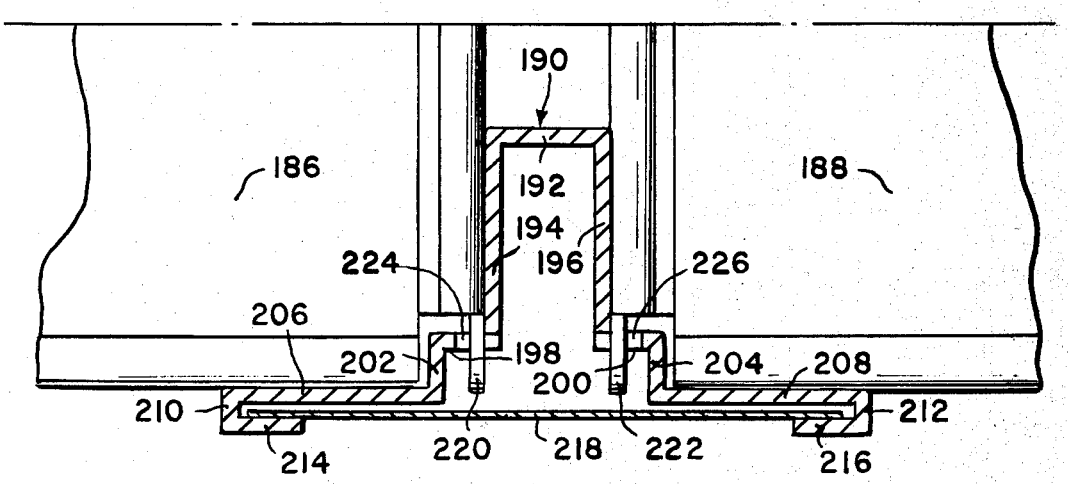
FIG. 14 is a horizontal section illustrating an alternative embodiment of the invention in which a single post of modified construction is used to support the adjacent front corners of two shelves arranged in side-by-side relationship.

In an alternative embodiment of the invention illustrated in FIG. 14, shelves 186 and 188 are supported in side-by-side relationship on a post 190. A series of such posts can be provided along a shopping aisle for supporting shelving along the aisle. Post 190 comprises a web having a rear section 192, two parallel sections 194 and 196 extending forwardly from section 192, sections 198 and 200, extending perpendicularly and outwardly from sections 194 and 196 respectively, sections 202 and 204 extending forwardly from sections 198 and 200 respectively, and sections 206 and 208 extending outwardly from sections 202 and 204 respectively. Short forwardly extending sections 210 and 212, and return flanges 214 and 216 provide grooves for receiving a trim sheet 218. Hooks 220 and 222 of the respective shelves are received in slots in web elements 198 and 200. These slots have camming surfaces 224 and 226 which respectively urge the sides of the shelves tightly against web elements 194 and 196. The hooks are similar to hook 138 in FIG. 11, and have oblique surfaces corresponding to surface 144, which act together with the slots to urge the shelves forwardly against web elements 206 and 208. In this manner, the shelves themselves serve to reinforce the post. The post, can of course comprise multiple telescoping post elements.

I claim:

1. A system of shelving comprising a shelf, and an upright supporting post, said shelf having a hook comprising a sheet metal projection lying in a substantially vertical plane and having a downwardly open notch, and said post comprising a sheet metal element lying in a substantially vertical plane and having a slot for receiving said hook; in which the notch of the hook has a first oblique camming surface engageable and cooperable with an edge of the slot for urging the shelf in a first horizontal direction with respect to the post as the hook is moved downwardly with respect to the post, and in which the slot has a second oblique camming surface engageable and cooperable with an edge of the sheet metal projection of the hook for urging the shelf in a second and different horizontal direction with respect to the post, and in which the post and shelf also have mutually engageable means for limiting the relative movement of the post and shelf in both of said first and second directions, said mutually engageable means being positioned so that they first come into engagement while said edges are in engagement with intermediate portions of their cooperating camming surfaces, whereby, upon downward movement of the shelf, said mutually engageable means become tightly engaged, and the shelf and post are rigidly secured together.

2. A system of shelving according to claim 1 having resilient means allowing said shelf to move downwardly with respect to the post beyond the position of the shelf at which said mutually engageable means first come into engagement.

3. A system of shelving according to claim 1 in which said post has first and second surfaces disposed in mutually perpendicular vertical planes, in which said shelf has an article-supporting surface with first and second mutually perpendicular skirt flanges, in which said mutually engageable means comprises said first and second surfaces of the post and said first and second skirt flanges of the shelf, and in which said first oblique camming surface and its cooperating edge of the slot are arranged so that said first horizontal direction is perpendicular to both of said first surface of the post and said first skirt flange, and said second oblique camming surface and its cooperating edge of the hook are arranged so that said second horizontal direction is perpendicular to both of said second surface of the post and said second skirt flange, whereby, upon downward movement of the shelf, said first skirt flange approaches and becomes tightly engaged with said first surface of the post, and said second skirt flange approaches and becomes tightly engaged with said second surface of the post.

4. A system of shelving according to claim 3 having resilient means allowing said shelf to move downwardly with respect to the post beyond the position of the shelf at which said skirt flanges first come into engagement respectively with said first and second surfaces of the post.

5. In a shelving system, an upright shelf supporting post comprising first and second elongated, sheet metal post elements in telescoping relationship with each other the second element extending upwardly from the upper end of the first element, each of said elements being so formed as to provide first and second grooves extending vertically substantially the full length of the element, the first groove of the first element being substantially aligned with the first groove of the second element, and the second groove of the first element being substantially aligned with the second groove of the second element, whereby the assembled post has two grooves extending vertically substantially the full length thereof, and an elongated, flexible sheet, coilable about an axis transverse to its lengthwise direction, extending substantially the full length of the post, and having substantially parallel opposite edges extending in the lengthwise direction, said parallel opposite edges being received in and retained by the respective grooves of the post.

6. A shelving system according to claim 5 in which each post element comprises web means having opposite vertical edges and in which said first and second grooves of each post element are provided by return flanges formed at the opposite vertical edges of the web means.

7. A shelving system according to claim 6 in which: said web means of each post element comprises a pair of vertically elongated sections disposed in non-parallel vertical planes, said sections being connected together so that each section is located substantially entirely on one side of the plane of the other section; in which said opposite vertical edges of the web means are constituted by vertical edges of said vertically elongated sections; and in which the return flange on each vertically elongated section is located on the side thereof opposite the side on which the other vertically elongated section is located.

8. A shelving system according to claim 7 in which the horizontal width of the coilable flexible sheet is such that, when said parallel opposite edges are received in and retained by the respective grooves of the post, the face of the sheet away from the web is convex and in which the sheet has a spring characteristic such that outer portions of said sheet bear outwardly against said return flanges.

9. A shelving system according to claim 7 in which each of said first and second post elements has V-shaped means connecting its vertically elongated sections to each other, said V-shaped means forming part of the web and being arranged so that the horizontal cross-sections of the web are W-shaped, and said V-shaped means having shelf hook-receiving slots formed therein, and providing a pocket for the ends of the hooks, thereby preventing the ends of the hooks from interfering with said coilable flexible sheet.

10. In a shelving system, an upright shelf supporting post element comprising web means having opposite vertical edges, and return flanges formed at said opposite vertical edges to provide first and second grooves extending vertically substantially the full length of the element, and an elongated, flexible sheet, coilable about an axis transverse to its lengthwise direction, extending substantially the full length of the element, and having substantially parallel opposite edges extending in the lengthwise direction, said parallel opposite edges being received in and retained by the respective first and second grooves; and in which said web means comprises a pair of vertically elongated sections disposed in non-parallel vertical planes, said sections being connected together so that each section is located substantially on one side of the plane of the other section; in which said opposite vertical edges of the web means are constituted by vertical edges of said vertically elongated sections; in which the return flange on each vertically elongated section is located on the side thereof opposite the side on which the other vertically elongated section is located; and having V-shaped means connected said vertically elongated sections to each other, said V-shaped means forming part of the web and being arranged so that the horizontal cross-sections of the web are W-shaped, and said V-shaped means having shelf hook-retaining slots formed therein, and providing a pocket for the ends of the hooks, thereby preventing the ends of the hooks from interfering with said coilable flexible sheet.

11. A shelving system according to claim 10 in which the horizontal width of the coilable flexible sheet is such that, when said parallel opposite edges are received in and retained by the respective grooves, the face of the sheet away from the web is convex, and in which the sheet has a spring characteristic such that outer portions of the sheet bear outwardly against said return flanges.

12. In a sheet metal shelving system, a base comprising: a first panel disposed in a vertical plane and having a vertical edge, a second panel disposed in a vertical plane perpendicular to the plane of said first panel, said first and second panels meeting each other at a corner of said base, means on said first panel providing a first flange extending generally perpendicularly from said vertical edge, means on said second panel providing a second flange extending generally pependicularly from said second panel and parallel to said first panel, and a third flange extending from said second flange and forming an acute angle therewith, said third flange extending toward the corner formed by said first panel and said first flange, and means rigidly secured to said second panel and providing a first surface generally perpendicular to said second flange and a second surface spaced from and generally parallel to said second flange, and in which said first panel is disposed against said second surface, said first flange is disposed against said first surface, and in which the outer edge of the third flange bears against the corner formed by said first panel and said first flange and holds said first panel in engagement with said second surface and holds said first flange against said first surface.

13. A shelving system according to claim 12 in which the upper edge of the third flange is tapered, whereby, as said first flange is moved downwardly into the space between said second flange and said second surface, the tapered upper edge of the third flange serves as a cam urging the first flange toward the first surface.

14. A shelving system according to claim 12 in which the lower edge of the first flange is tapered whereby said tapered lower edge serves as a cam cooperating with said second flange to urge said first panel against said second surface as said first flange is moved downwardly into the space between said second flange and said second surface.

15. A shelving system according to claim 12 or 13 or 14 in which said means rigidly secured to the second panel is a shelf-supporting post extending upwardly from the second panel.

16. A sheet metal shelving system kit comprising:

a first pair of post elements permanently secured in parallel relationship to each other at opposite ends of a first base panel to provide a first generally U-shaped unit;

a second pair of post elements permanently secured in parallel relationship to each other at opposite ends of a second base panel to provide a second generally U-shaped unit;

third and fourth base panels;

means for securing said third and fourth base panels to said first and second base panels to provide a generally rectangular base from the corners of which said post elements extend upwardly in parallel relationship to each other;

four additional post elements; and means for securing said additional post elements respectively at the upper ends of the post elements of the first and second pair.

* * * * *